US006276531B1

(12) United States Patent
Andrews

(10) Patent No.: US 6,276,531 B1
(45) Date of Patent: Aug. 21, 2001

(54) MOLDED FIBER NESTABLE EGG TRAY PACKAGING SYSTEM

(75) Inventor: Alan P. Andrews, Mundelein, IL (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/516,133

(22) Filed: Mar. 1, 2000

(51) Int. Cl.[7] ..... B65D 85/32; B65D 21/04

(52) U.S. Cl. ..... 206/521.1; 206/511; 206/564

(58) Field of Search ..... 206/521.1, 521.3–521.9, 206/509, 511, 564, 557, 497; 220/377

(56) References Cited

U.S. PATENT DOCUMENTS

| | | |
|---|---|---|
| 1,969,802 | 8/1934 | Koppelman . |
| 2,066,587 | 1/1937 | Swift, Jr. . |
| 2,517,465 | 8/1950 | Cox . |
| 2,655,305 | 10/1953 | Schilling . |
| 2,771,233 | 11/1956 | Cox . |
| 2,844,268 | 7/1958 | Lambret . |
| 2,885,136 | 5/1959 | Grant . |
| 2,888,183 | 5/1959 | Reifers . |
| 2,950,726 | 8/1960 | Kuhl et al. . |
| 2,990,094 | 6/1961 | Reifers . |
| 2,997,196 | 8/1961 | Emery . |
| 3,016,176 | 1/1962 | Reifers et a. . |
| 3,028,065 | 4/1962 | Reifers . |
| 3,034,693 | 5/1962 | Cox . |
| 3,120,901 | 2/1964 | Boyd . |
| 3,128,932 | 4/1964 | Reifers . |
| 3,185,370 | 5/1965 | Reifers et al. . |
| 3,192,050 | 6/1965 | Almquist . |
| 3,192,770 | 7/1965 | Roberston . |
| 3,207,409 | 9/1965 | Reifers et al. . |
| 3,217,963 | 11/1965 | Alsman . |
| 3,234,077 | 2/1966 | Reifers et al. . |
| 3,276,656 | 10/1966 | Hartmann et al. . |
| 3,337,110 | 8/1967 | Commisso et al. . |

(List continued on next page.)

FOREIGN PATENT DOCUMENTS

| | | | |
|---|---|---|---|
| 52682/59 | | 3/1960 (AU) . | |
| 44927/64 | | 12/1965 (AU) . | |
| 17993/34 | | 1/1995 (AU) . | |
| 705727 | | 3/1965 (CA) . | |
| 001047491 | * | 12/1953 (FR) | 206/521.1 |
| 1200661 | | 7/1970 (GB) . | |
| WO 087002336 | * | 4/1987 (WO) | 206/521.1 |

*Primary Examiner*—Bryon P. Gehman
(74) *Attorney, Agent, or Firm*—Jenkens & Gilchrist

(57) ABSTRACT

This invention deals with an egg tray system comprising a base (filler flat) and a transparent lid that provides lateral stability for the trays when stacked but that avoids the increasing cost that results from the eggs being damaged or broken. The lid is formed of transparent synthetic material that facilitates visual inspection of the eggs and is comprised of upwardly extending conical shaped elements and contains a downwardly shaped rim that is comprised of notches that assist in securing the lid to the filler flat. The filler flat is comprised of a plurality of downwardly extending pockets and a plurality of upwardly extending posts. A shrink film band is placed around the filler flat with lid applied to secure the lid during handling and make the finished product "tamper evident." The shrink film band may be pre-printed with product information and other relevant items. Alternatively, one or more elastic bands can be placed between rows of the expansions on the lid of the egg tray system 10 in order to secure the lid to the filler flat. The egg tray systems of the present invention also rest on top of one another such that each egg tray system is rotated approximately ninety degrees to "nest" inside of the underlying egg tray system and allow an increased number of eggs to be securely stored.

32 Claims, 3 Drawing Sheets

U.S. PATENT DOCUMENTS

| | | | |
|---|---|---|---|
| 3,356,284 | | 12/1967 | Lake . |
| 3,362,605 | | 1/1968 | Bixler . |
| 3,398,875 | | 8/1968 | Snow et al. . |
| 3,446,417 | | 5/1969 | Eisenberg . |
| 3,451,577 | | 6/1969 | Nurick . |
| 3,458,108 | | 7/1969 | Howarth et al. . |
| 3,471,078 | | 10/1969 | Seest et al. . |
| 3,501,083 | | 3/1970 | Lake . |
| 3,558,037 | | 1/1971 | Andrews . |
| 3,563,446 | | 2/1971 | Lake . |
| 3,567,107 | | 3/1971 | Artz . |
| 3,568,914 | | 3/1971 | Ahlmeyer . |
| 3,572,578 | | 3/1971 | Rohdin . |
| 3,580,480 | | 5/1971 | French . |
| 3,643,855 | | 2/1972 | Donaldson . |
| 3,645,436 | | 2/1972 | Boyd et al. . |
| 3,661,317 | | 5/1972 | Noguchi . |
| 3,661,320 | | 5/1972 | Donaldson . |
| 3,664,574 | | 5/1972 | Pearl et al. . |
| 3,669,606 | | 6/1972 | Brown . |
| 3,670,952 | | 6/1972 | Venuti et al. . |
| 3,672,560 | | 6/1972 | Voorhis et al. . |
| 3,672,693 | | 6/1972 | Weir . |
| 3,687,350 | | 8/1972 | Warburton . |
| 3,687,355 | | 8/1972 | Dahlberg . |
| 3,813,027 | | 5/1974 | Misdom, Jr. et al. . |
| 3,817,441 | * | 6/1974 | Jackson . |
| 3,920,178 | | 11/1975 | Moller . |
| 3,985,289 | | 10/1976 | Prince . |
| 4,025,038 | | 5/1977 | Reifers et al. . |
| 4,057,188 | * | 11/1977 | Steinhardt ..... 206/521.1 X |
| 4,081,123 | | 3/1978 | Reifers . |
| 4,087,040 | | 5/1978 | Besset et al. . |
| 4,087,042 | | 5/1978 | Moller . |
| 4,194,682 | | 3/1980 | Congleton et al. . |
| 4,205,777 | | 6/1980 | Brown et al. . |
| 4,280,648 | | 7/1981 | Boursier . |
| 4,298,156 | | 11/1981 | Reifers et al. . |
| 4,335,813 | | 6/1982 | Bessett et al. . |
| 4,361,263 | | 11/1982 | Thomas . |
| 4,394,214 | | 7/1983 | Bixler et al. . |
| 4,449,629 | * | 5/1984 | Barrieau ..... 206/373 X |
| 4,463,894 | | 8/1984 | Daines . |
| 4,471,881 | | 9/1984 | Foster . |
| 4,492,331 | | 1/1985 | Bixler et al. . |
| 4,625,905 | | 12/1986 | Mangla . |
| 4,821,901 | | 4/1989 | Bixler . |
| 5,183,159 | * | 2/1993 | Hojnacki et al. ..... 206/563 |

* cited by examiner 40
40
30
30
20
28
10
28
27
27
25
60
28
27
32
27
14
12
55
50
70
40
28
28
27
27
27
12
27
28
30
25
10'
32
14
60
55
70
50

MOLDED FIBER NESTABLE EGG TRAY PACKAGING SYSTEM

TECHNICAL FIELD OF THE INVENTION

The present invention relates generally to an egg tray packaging system. More particularly, the present invention relates to the use of a shrink film band enwrapping a molded fiber egg tray (filler flat) with a plastic dome lid to allow the egg tray system to securely nest within an underlying egg tray system.

BACKGROUND OF THE INVENTION

Popular egg and fruit trays encounter significant breakage and/or damage during delivery and storage. Care must be exercised in the collecting, processing, and handling of produce in order to prevent damaging or breaking the fruits, vegetables and other produce including eggs. A disadvantage of presently marketed trays for retail sale is that there is not a transparent protective lid to these trays and the eggs are forced to support at least a portion of the overlying trays.

Generally, as most grocers and warehouse retailers require a large sum of eggs and other produce yet do not have a large floor area for storage and/or display, such egg trays are often stacked to a substantial height and thus, can be insecure and unstable. Furthermore, presently marketed egg trays do not nest within each other and a large volume of retail space is required to display and store the egg trays. Some current egg trays contain a flat corrugated sleeve that slides over the egg trays but does not reduce stacking volume. Another shortcoming of currently retailed egg trays is that they do have not a secure lid or other feature to prevent egg tampering.

Accordingly, it is desirable to produce a secure and stable egg tray system that overcomes each of the shortcomings listed above and that virtually eliminates egg damage and breakage, promotes "tamper evident" packaging and increases the amount of eggs that can be safely and securely stored.

SUMMARY OF THE INVENTION

This invention deals with an egg tray system comprising a base (otherwise known as a filler flat) and a transparent lid that provides lateral stability for the trays when stacked but that avoids the difficulty of damaging or breaking the eggs. The lid is formed of transparent synthetic material that facilitates visual inspection of the eggs and is comprised of upwardly extending conical shaped elements and contains a rim that is comprised of notches that assist in securing the lid to the filler flat. The filler flat is comprised of a plurality of downwardly extending pockets and a plurality of upwardly extending posts. A shrink film band is placed around the filler flat with the lid applied to secure the lid during handling and make the finished product "tamper evident." The shrink film band may be pre-printed with product information and other relevant items. The egg tray systems of the present invention also rest on top of one another such that each egg tray system is rotated approximately ninety degrees to "nest" inside of the underlying egg tray system and allow an increased number of eggs to be securely stored.

BRIEF DESCRIPTION OF THE DRAWINGS

Other objects and advantages of the invention will become apparent upon reading the following description of illustrative embodiments and upon reference to these drawings.

Figure 1:
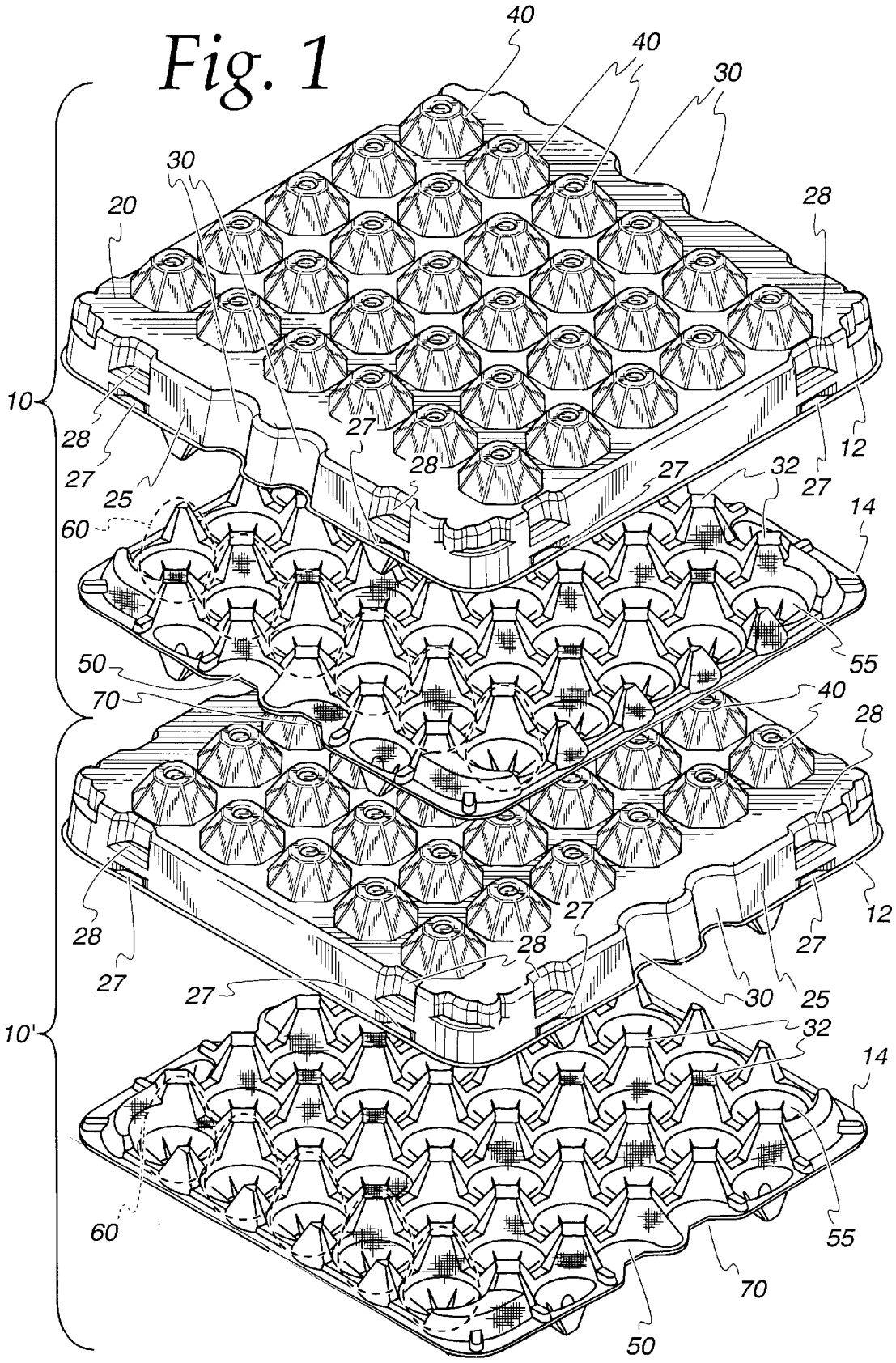
FIG. 1 is a perspective illustration of two egg tray systems according to one embodiment of this invention.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary the invention is to cover all modifications, equivalents, and alternatives that fall within the spirit and scope of the invention as defined by the appended claims.

DESCRIPTION OF ILLUSTRATIVE EMBODIMENTS

A numeral 10 in the figures of the present invention generally refers to an egg packaging tray system comprising an egg tray lid 12 and a filler flat 14 (those skilled in the art refer to a molded fiber egg tray as a "filler flat"). A numeral 10' refers to another egg tray system according to the present invention, disposed below and rotated ninety degrees respective to egg tray system 10. While the figures for the present application have been drawn to depict egg trays, one skilled in the art will contemplate that the trays of the present invention can be used for produce and other types of fruit.

The egg tray lid 12 is composed of a transparent plastic or synthetic material and is designed to snap over the filler flat 14. The novel combination of a filler flat and a transparent lid promotes easy visibility of the eggs, increased stability, lower breakage rates for an improved egg tray system. The egg tray lid 12 of the present invention allows the eggs to be fully covered and protected from contamination and damage by overlying trays. Furthermore, the clear plastic lid allows the consumer to inspect the eggs before purchase.

The egg tray lid 12 is comprised of a lid surface 20, a downwardly-extending rim 25, a plurality of finger slots 30 on opposing sides of the rim 25, and a plurality of conical-shaped expansions 40 extending from the rectangular-shaped generally horizontal top surface 20 of the egg tray lid 12. The shape of the egg tray lid 12 is designed to allow sufficient space, between the expansions 40, for corresponding pockets of an overlying lid, to nest so that the upright posts of the underlying tray support the weight of an overlying egg tray system.

The rim 25 extends downwardly from each of the exterior edges of the lid surface 20 of the egg tray lid 12. In order to secure the egg tray lid 12 to the filler flat 14, lower notches 27 and upper notches 28 extend inwardly from opposing ends of each side of the rim 25. When the egg tray lid 12 is placed over the filler flat 14, the lowest parts of the rim 25 extend below the base surface 50 of the filler flat 14. When in place, the lower notches 27 of the rim 25 of the egg tray lid 12 extend inwardly and just below the base surface 50 and the upper notches 28 of the rim 25 of the egg tray lid 12 extend inwardly and just above the base surface 50 to secure the egg tray lid 12 to the filler flat 14.

In use, the lid 12 is placed over the top of the filler flat 14. The lower notches 27 of the rim 25 of the lid 12 extend under the base surface 50 and the upper notches 28 of the rim 25 extend over the base surface 50. When each of the upper notches 28 and lower notches 27 are in place, the lid 12 snaps onto the filler flat 14 and forms an attachment between the filler flat 14 and the lid 12. The snap-on notches of the present invention allow easy assembly of the egg tray systems of the present invention.

It is preferable in order to maintain stability and strength of the egg tray system 10 that more than one upper notch 28 and more than one lower notch 27 are disposed on each side of the rim 25. It is contemplated in accordance with the present invention that more than or less than two lower notches 27 and two upper notches 28 could be disposed on each side of the rim 25. It is further contemplated that the lower notches 27 and the upper notches 28 could be disposed in alternate locations on the rim 25. For example, a single lower notch 27 and a single upper notch 28 may be located in a central location on each side of the rim 25.

As shown in FIG. 1, finger slots 30 exist on two opposing sides of the rim 25. The finger slots 30 provide adequate space for a user's fingers to be removed from the egg packaging tray system 10 when a filled tray system 10 is being loaded for packing and shipping. It is contemplated in accordance with the present invention that the two sides of the rim 30 that do not possess finger holes could state, for example, product information or nutritional information. This information is placed on the shrink film is band, as discussed below.

The conical-shaped expansions 40 that protrude upwardly from the lid surface 20 provide secure housing for an upper portion of each egg and provide for easy visibility of the eggs. As shown in FIG. 1, thirty expansions 40 (six expansions disposed in each of five rows) protrude from the lid surface 20. It is contemplated in accordance with the present invention, however, that the egg tray systems 10 could be of different sizes to provide an alternate number of eggs within each tray system (with and a corresponding number of expansions 40). The egg tray system 10 can be designed to possess, for example, four, six, twelve, eighteen, twenty, twenty-four or thirty-six conical expansions and a corresponding number of eggs. A variety of different configurations exists for each different size egg tray system. For example, an egg tray system possessing 12 eggs can be configured to have 3 rows of 4 eggs each or 2 rows of 6 eggs each.

The filler flat 14 is composed of a molded fiber material and comprises a base surface 50, a plurality of posts 32 and a plurality of pockets 55. Within the generally horizontal base surface 50 are located the plurality of pockets 55, each designed to securely retain and hold the lower portion of an egg 60. Several indentations 70 are formed into two opposing sides of the base surface 50. These indentations 70 of the base surface correspond to the location of the finger slots 30 in order for the finger slots 30 to align with the base surface 50.

Figure 3:
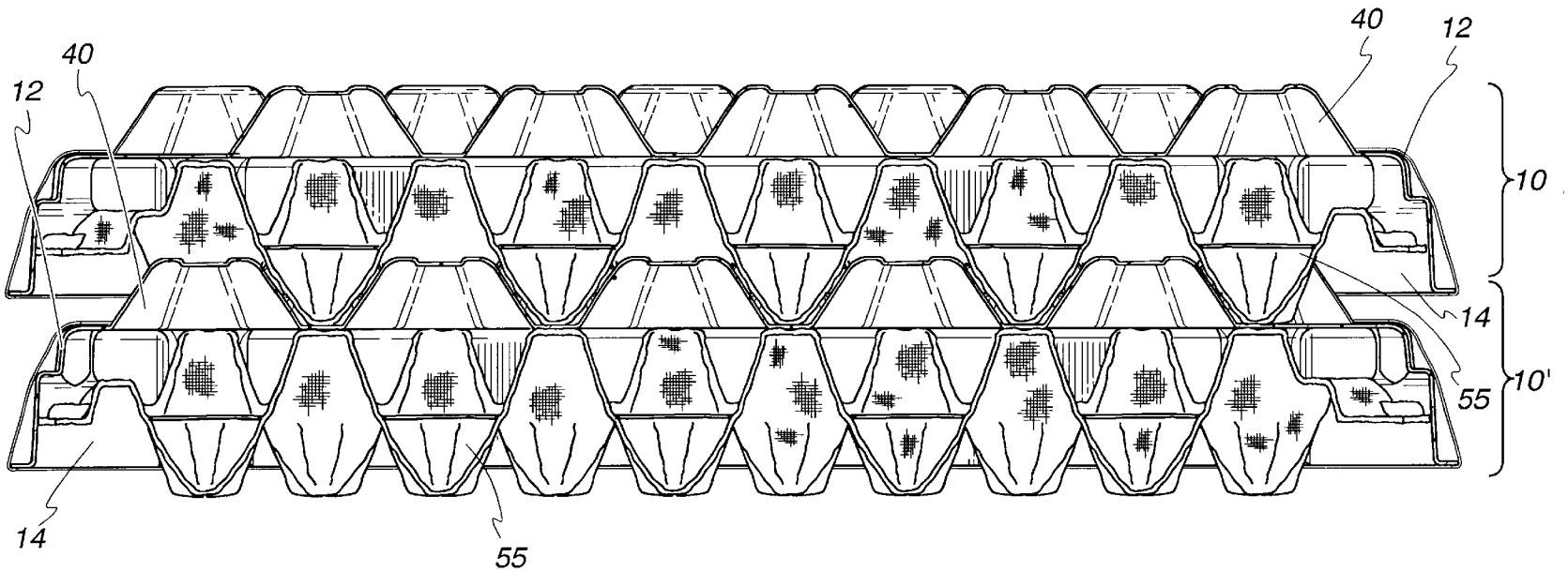
FIG. 3 is a sectional view taken generally through line 3—3 in FIG. 2.

A plurality of posts 32 are disposed within the filler flat 14. As shown in FIGS. 1 and 3, after attaching a lid to the filler flat of the lower egg tray system 10', each pocket 55 of the overlying filler flat (of the upper egg tray system 10) nests between the expansions of the underlying lid and is supported by the corresponding post of the underlying filler flat. The overlying filler flats do not substantially touch the expansions of the underlying lid. It is contemplated that the overlying filler flats can skim the sides of the expansions, however, the posts are designed to bear the entire weight of the overlying tray(s).

The underside of each pocket is designed to maximize the stability and security of egg tray systems and reduce the likelihood that eggs will break within each egg tray system. For example, the underside of each pocket could be formed to have a "t-shaped" or four-pronged form. As shown in FIG. 3, the underside of each pocket is designed such that the expansions 40 do not bear the weight of the overlying tray system and the pockets of the overlying tray system 10 rest on the posts of the tray system 10'. The posts of the present invention are designed to bear the weight of all overlying tray systems. In use, retailers and/or shippers stack 5 or 6 or more egg tray systems on top of each other.

Figure 2:
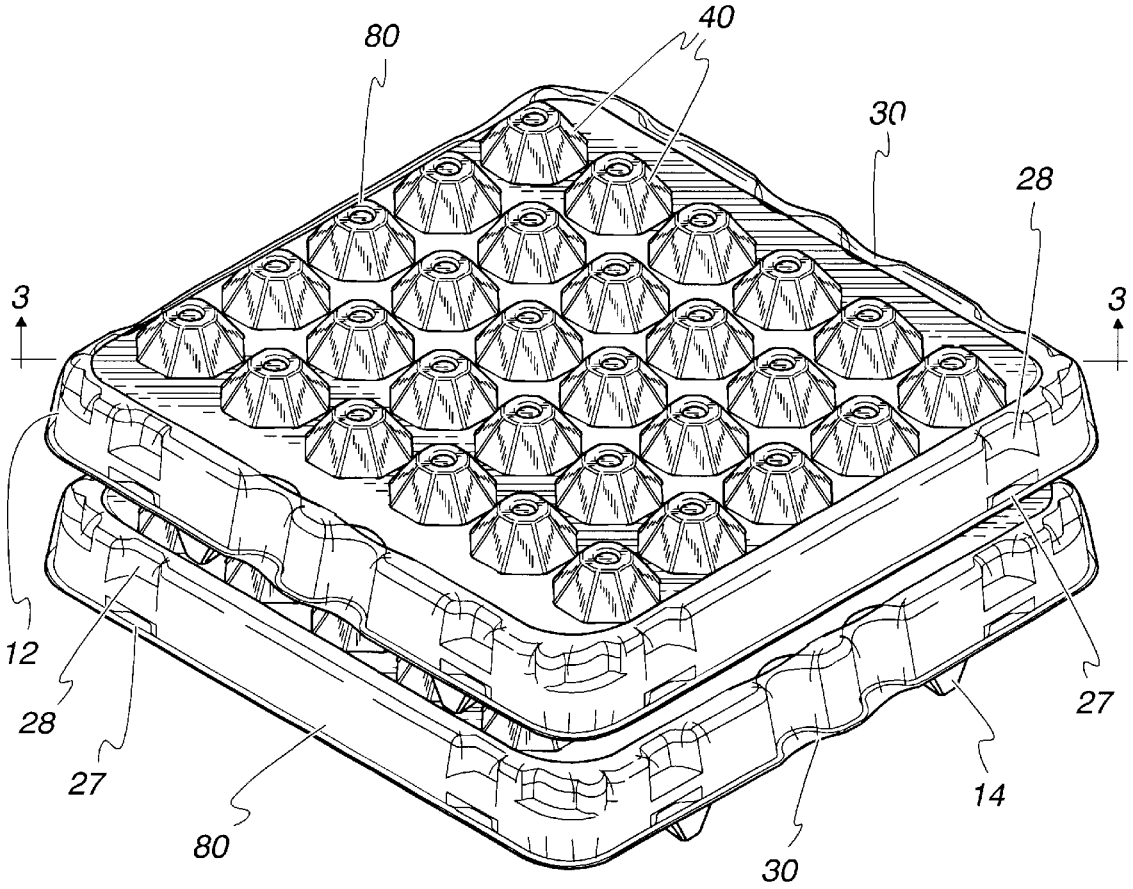
FIG. 2 is a perspective illustration of two egg tray systems embodying this invention.

After each of the pockets 55 within the filler flat 14 have been filled with eggs 60 and the egg tray lid has been positioned and secured, as shown in FIG. 2, a shrink film band 80 is placed around the egg tray system to allow product identification and tamper-evidence. Shrink bands formed from shrink film manufactured by, for example CMS Gilbreth of Craydon, Pa. or Coastal Sleeve Label, Inc. of Brunswick, Ga. may be used. Once placed, the shrink film band 80 will also ensure egg tray security by preventing the detachment of the egg tray lid 12 from the filler flat 14 until consumption is desired.

Specifically, after the eggs have been placed within the filler flat 14 and the lid 12 has been attached and secured by the upper and lower notches, 27 and 28, respectively, a predetermined length of shrink film about 50 mm wide is removed from a shrink film roll or tube, a shrink film band is placed around the rim 25 of the lid 12. It is contemplated in accordance with the present invention that the shrink film band 80 is wide enough such that when the shrink film band 80 is heated to shrink around the outer surface of the rim 25, a portion of the shrink film band 80 shrinks around the filler flat 14 in order to further secure the lid 12 to the filler flat 14. Specifically, the shrink film band 80 will cause the lid 12 to cinch to the filer flat 14 and further secure the lower notches 27 and the upper notches 28 in position against the filler flat 14. Thus, it is contemplated that the shrink film band 80 could be less than or more than 50 mm wide so long as the filler flat 14 is secured to the lid 12. It is contemplated that the shrink film band 80 could be pre-printed with product or nutritional information. It is further contemplated that a label could be placed on the shrink film band 80 that possesses such product or nutritional information. This information is disposed on the two sides of the rim 25 that the finger holes are not located.

Once the shrink film band 80 is placed generally around the rim 25, the egg tray system 10 is heated, using a heat tunnel or other techniques commonly known in the art, in order to shrink the shrink film around the outside of the rim to secure the lid 12 to the filler flat 14. The egg tray is subject to heat for approximately 5 to 15 seconds. The egg tray system is subjected to heat before refrigeration of the eggs. This amount of heating time does not damage the eggs located within the egg tray. A shrink film band is placed around the exterior of the rim instead of around the entire device to allow for the finished product to nest within an underlying egg tray system as described above.

A further embodiment of the present invention introduces an alternative method to secure the lid 12 to the filler flat 14 of the egg tray system 10. One or more elastic band(s) can be placed between rows of the expansions 40 on the lid 12 of the egg tray system 10. Specifically, a roll of elastic material is placed on a wrapping machine. For example, elastic material and machines manufactured by Delta Cyklop of Charlotte, N.C. may be used. A full egg tray is placed on this machine and the elastic material is directed around the entire tray, and specifically located between an outer row of expansions 40 and next row of expansions 40 located to the interior of the lid 12. Another elastic band is placed on the egg tray system 10 by installing a second predetermined length of elastic material around the entire tray, specifically located between the outer row of expansions on the opposing side of the lid 12 and the next row of expansions 40 to the interior of the lid 12.

As shown in the cross-sectional view of FIG. 3, as taken generally through lines 3—3 of FIG. 2, an egg tray system 10 is seated on top of another egg tray system 10'. In order to seat, or "nest", the egg tray system 10 within the other system 10', the egg tray system 10 is rotated approximately ninety degrees to allow the pockets 55 of the overlying egg tray system 10 to nest between the conical-shaped expansions 40 of the underlying egg tray system 10' and generally on top of the posts 32 of the underlying egg tray system 10'. Because a portion of the pockets of each egg tray system rests inside the expansions of the underlying egg tray system, a greater number of eggs can be stored within the egg tray system of the present invention than most currently used egg trays that use a single-face corrugated sleeve.

Comparative Example

Up to about 40% more eggs can be shipped and displayed in retail stores in about the same volume with the use of the egg tray system of the present invention. Five corrugated sleeve filler flats currently marketed were stacked on top of each other, without the use of a lid and without taking advantage of the nesting feature of the present invention. These five corrugated sleeve filler flats were 13⁹⁄₁₆" tall.

Seven egg tray systems of the present invention were stacked and nested, as described above. The height of the nested egg tray systems was 14¹⁄₁₆". Thus, comparing the two stacks of egg trays, the seven egg tray systems of the present invention were ½" taller than the five stacked egg trays that are presently marketed. Thus, presuming each egg tray contains the same amount of eggs, seven egg tray systems of the present invention can be shipped, displayed and sold in approximately the same volume as five currently marketed egg trays (about a 40% increase in eggs that can be shipped, displayed and sold).

While the present invention has been described with references to one or more particular embodiments, those skilled in the art will recognize that many changes may be made thereto without departing from the spirit and scope of the present invention.

Each of these embodiments and obvious variations thereof is contemplated as falling within the spirit and scope of the present invention, which is set forth in the following claims:

1. An egg tray packaging system comprising a transparent lid and at least one base separate from said lid, said lid being configured to be secured to said base, said lid comprising a lid surface, a plurality of conical-shaped elements extending upwardly from said lid surface, and a rim that encompasses and extends downwardly from said lid surface, said base comprising a plurality of downwardly extending pockets aligned in a predetermined manner for orientation with said conical-shaped elements of said lid and a plurality of upwardly extending posts disposed between said pockets and aligned in a predetermined manner to allow said lid surface to rest on said upwardly extending posts.

2. The egg tray packaging system of claim 1, wherein said lid and said base are further secured together by placing a shrink film band around said base and said rim of said lid and applying heat to said band to simultaneously shrink said band around the circumference of said rim and the circumference of said base.

3. The egg tray packaging system of claim 1, wherein said lid and said base are further secured together by placing at least one elastic band between the rows of said conical-shaped elements of said lid.

4. The egg tray packaging system of claim 1, wherein said lid contains from the group consisting of 6, 12, 20, 24, and 30 conical-shaped elements and the base contains a corresponding number of pockets.

5. The egg tray packaging system of claim 1, wherein said rim comprises a plurality of pairs of upper notches and lower notches extending inwardly from opposing ends of each side of said rim, each of said pairs designed to secure said lid to said base.

6. The egg tray packaging system of claim 1, wherein said egg tray packaging system is adapted to hold at least 6 eggs.

7. The egg tray packaging system of claim 1, wherein said egg tray packaging systems is adapted to hold at least 12 eggs.

8. The egg tray packaging system of claim 1, wherein said egg tray packaging systems is adapted to hold at least 20 eggs.

9. The egg tray packaging system of claim 1, wherein said egg tray packaging systems is adapted to hold at least 24 eggs.

10. The egg tray packaging system of claim 1, wherein said egg tray packaging system is adapted to hold at least 30 eggs.

11. A first tray packaging system comprising a transparent lid and an adjacent base, said lid secured to said base, said lid comprising a lid surface, a plurality of upwardly extending conical-shaped elements, and a rim that encompasses and extends downwardly from said lid surface, said rim containing a plurality of pairs of upper notches and lower notches, each of said pairs designed to secure said lid to said base, said base comprising a plurality of downwardly extending pockets aligned in a predetermined manner for orientation with said elements of said lid and a plurality of upwardly extending posts disposed between said pockets and aligned in a predetermined manner to allow said lid surface to rest on said upwardly extending posts.

12. The first tray packaging system of claim 11, wherein said pockets of said base can rest between the elements of a lid of an underlying second tray packaging system by rotating said first tray packaging system about 90 degrees and placing said first tray packaging system on top of and nested partially within said underlying second tray packaging system.

13. The first tray packaging system of claim 11, wherein said lid and said base are further secured together by placing a shrink film band around said base and said rim of said lid and applying heat to said band to simultaneously shrink said band around the circumference of said rim and the circumference of said base.

14. The first tray packaging system of claim 11, wherein said lid and said base are further secured together by placing at least one elastic band between the rows of said elements of said lid.

15. The egg tray packaging system of claim 11, wherein said lid contains from the group consisting of 6, 12, 20, 24, and 30 conical-shaped elements and the base contains a corresponding number of pockets.

16. A first tray packaging system comprising a transparent lid and an adjacent base, said lid secured to said base, said lid comprising a lid surface, a plurality of upwardly extending conical-shaped elements, and a rim that encompasses and extends downwardly from said lid surface, said base comprising a plurality of downwardly extending pockets aligned in a predetermined manner for orientation with said conical-shaped elements of said lid and a plurality of upwardly extending posts disposed between said pockets and aligned in a predetermined manner to allow said lid surface to rest on said upwardly extending posts, wherein said pockets of said base can rest between said elements of a lid of an underlying second tray packaging system by rotating said first tray packaging system about 90 degrees relative to the second tray packaging system and placing said first tray packaging system on top of and nested partially within the second tray packaging system.

17. The first tray packaging system of claim 16, wherein said lid and said base are further secured together by placing a shrink film band around said base and said rim of said lid and applying heat to said band to simultaneously shrink said band around the circumference of said rim and the circumference of said base.

18. The first tray packaging system of claim 16, wherein said lid and said base are further secured together by placing at least one elastic band between the rows of said elements of said lid.

19. The first egg tray packaging system of claim 16, wherein said lid contains from the group consisting of 6, 12, 20, 24, and 30 conical-shaped elements and the base contains a corresponding number of pockets.

20. The egg tray packaging system of claim 16, wherein said rim comprises a plurality of pairs of upper notches and lower notches extending inwardly from opposing ends of each side of said rim, each of said pairs designed to secure said lid to said base.

21. A first tray packaging system comprising a transparent lid and an adjacent base, said lid secured to said base, said lid comprising a lid surface, a plurality of upwardly extending conical-shaped elements, and a rim that encompasses and extends downwardly from said lid surface, and said base comprising a plurality of downwardly extending pockets aligned in a predetermined manner for orientation with said elements of said lid and a plurality of upwardly extending posts disposed between said pockets and aligned in a predetermined manner to allow said lid surface to rest on said upwardly extending posts, wherein said rim containing a plurality of pairs of upper notches and lower notches, each of said pairs designed to secure said lid to said base, wherein said pockets of said base can rest between the elements of a lid of an underlying second tray packaging system by rotating said first tray packaging system about 90 degrees relative to the second tray packaging system and placing said first tray packaging system on top of and nested partially within the second tray packaging system and wherein said lid and said base of said first tray packaging system are further secured together by placing a shrink film band around said base and said rim of said lid and applying heat to said band to simultaneously shrink said band around the circumference of said rim and the circumference of said base.

22. The first egg tray packaging system of claim 21, wherein said lid contains from the group consisting of 6, 12, 20, 24, and 30 conical-shaped elements and the base contains a corresponding number of pockets.

23. A first tray packaging system comprising a transparent lid and an adjacent base, said lid secured to said base, said lid comprising a lid surface, a plurality of upwardly extending conical-shaped elements, and a rim that encompasses and extends downwardly from said lid surface, and said base comprising a plurality of downwardly extending pockets aligned in a predetermined manner for orientation with said elements of said lid and a plurality of upwardly extending posts disposed between said pockets and aligned in a predetermined manner to allow said lid surface to rest on said upwardly extending posts, wherein said lid and said base of said first tray packaging system are further secured together by placing at least one elastic band between the rows of said elements of said lid, wherein said rim containing a plurality of pairs of upper notches and lower notches, each of said pairs designed to secure said lid to said base, wherein said pockets of said base can rest between the elements of a lid of an underlying second tray packaging system by rotating said first tray packaging system about 90 degrees relative to the second tray packaging system and placing said first tray packaging system on top of and nested partially within the second tray packaging system.

24. The first egg tray packaging system of claim 23, wherein said lid contains from the group consisting of 6, 12, 20, 24, and 30 conical-shaped elements and the base contains a corresponding number of pockets.

25. A method of stacking egg packages, each of said egg packages comprising a transparent lid and a separate base, said lid configured to be secured to said base, said lid comprising a lid surface, a plurality of upwardly extending conical-shaped elements and a rim that encompasses and extends downwardly from said lid surface, said base comprising a plurality of downwardly extending pockets aligned in a predetermined manner for orientation with said elements of said lid and a plurality of upwardly extending posts disposed between said pockets, said method comprising:

providing a said first egg package and a said second egg package;

rotating said first egg package about 90 degrees relative to said second egg package; and placing said first egg package on top of and nested partially within said second egg package wherein said pockets of said base of said first egg package can rest between said conical-shaped elements of the lid of said second egg package.

26. The method of claim 25, wherein the lid of said first egg package and said base of said first egg package are further secured together by placing a shrink film band around said base of said first egg package and said rim of said lid of said first egg package and applying heat to said band to simultaneously shrink said band around the circumference of said rim and the circumference of said base.

27. The method of claim 25, wherein said lid of said first egg package and said base of said first egg package are further secured together by placing at least one elastic band between the rows of said conical-shaped elements of said lid of said first egg package.

28. The method of claim 25, wherein each of said egg packages is adapted to hold at least 6 eggs.

29. The method of claim 25, wherein each of said egg packages is adapted to hold at least 12 eggs.

30. The method of claim 25, wherein each of said egg packages is adapted to hold at least 20 eggs.

31. The method of claim 25, wherein each of said egg packages is adapted to hold at least 24 eggs.

32. The method of claim 25, wherein each of said egg packages is adapted to hold at least 30 eggs.

* * * * *